US010124869B1

(12) United States Patent
Bailey

(10) Patent No.: US 10,124,869 B1
(45) Date of Patent: Nov. 13, 2018

(54) WATERCRAFT WITH MANUAL PROPULSION SYSTEM

(71) Applicant: Sunrunner Products, LLC, Paul Smiths, NY (US)

(72) Inventor: George William Bailey, Paul Smiths, NY (US)

(73) Assignee: Sunrunner Products, LLC, Paul Smiths, NY (US)

( * ) Notice: Subject to any disclaimer, the term of this patent is extended or adjusted under 35 U.S.C. 154(b) by 0 days.

(21) Appl. No.: 15/893,018

(22) Filed: Feb. 9, 2018

Related U.S. Application Data

(63) Continuation-in-part of application No. 15/595,346, filed on May 15, 2017.

(51) Int. Cl.

| | |
|---|---|
| ***B63B 35/73*** | (2006.01) |
| ***B63H 16/18*** | (2006.01) |
| ***B63H 16/04*** | (2006.01) |
| *B63B 35/83* | (2006.01) |
| *A63B 69/18* | (2006.01) |

(52) U.S. Cl.
CPC ..... *B63H 16/18* (2013.01); *B63H 16/04* (2013.01); *A63B 69/182* (2013.01); *B63B 35/83* (2013.01)

(58) Field of Classification Search
CPC ..... B63H 16/18; A63B 69/182; B63B 35/83
See application file for complete search history.

(56) References Cited

U.S. PATENT DOCUMENTS

| | | | | |
|---|---|---|---|---|
| 2,918,892 | A | 12/1959 | Town | |
| 4,157,597 | A * | 6/1979 | Trebnick | B63B 35/83 440/21 |
| 4,659,077 | A | 4/1987 | Stropkay | |
| 4,867,443 | A | 9/1989 | Jensen | |
| 4,960,276 | A | 10/1990 | Feuer et al. | |
| 5,194,023 | A | 3/1993 | Stone | |
| 5,669,793 | A * | 9/1997 | Walton | B63H 1/32 440/19 |
| 5,702,274 | A * | 12/1997 | White | B63H 16/14 114/61.22 |
| 5,885,194 | A * | 3/1999 | Wasserman | A63B 23/03541 482/111 |
| 6,106,442 | A | 8/2000 | Tissue | |
| 7,785,161 | B2 | 8/2010 | Wilkinson | |
| 2010/0151753 | A1 | 6/2010 | Abanto et al. | |

FOREIGN PATENT DOCUMENTS

| | | | | |
|---|---|---|---|---|
| DE | 2607764 A1 * | 9/1977 | | B63B 15/02 |
| DE | 2911023 A1 * | 9/1980 | | A63B 22/001 |
| GB | 191325012 A * | 6/1914 | | B63B 35/83 |

* cited by examiner

*Primary Examiner* — Andrew Polay
(74) *Attorney, Agent, or Firm* — James G. Passé; Passé Intellectual Property, LLC

(57) ABSTRACT

The present invention is a watercraft wherein a cross country simulator is connected to propulsion paddles to power movement of the watercraft.

10 Claims, 3 Drawing Sheets

WATERCRAFT WITH MANUAL PROPULSION SYSTEM

This application is a continuation-in-part of U.S. non-provisional application Ser. No. 15/595,346 filed on May 15, 2017, and which is incorporated herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a watercraft with a manual propulsion system. More particularly, the present invention relates to a watercraft which is propelled by a cross country simulator system that drives one or more paddle blades.

Description of Related Art

The use of cross-country (snow) skiing simulators to help exercise when one cannot actually cross country ski have become extraordinarily popular. Many included both ski movement as well as pole movement, such as shown in U.S. Pat. No. 4,867,443 (Jensen), while others rely on just the foot movements to get exercise. In general, these devices rely on some sort of endless loop cycling in order to provide both resistance and the front to back to front motion associated with cross country skiing.

Like stationary bicycles, one of the biggest problems with stationary exercise is the monotony compared to actually being outside. Some outdoor cross country ski simulators do exist, but those usually involve a more roller skate type activity rather than a true Nordic type ski movement. The cross country ski movement is well known, with two feet moving front to back and two poles also moving front to back with feet and poles alternating direction. One direction is a power stroke and one direction is a return stroke.

In one device, there is a water craft with a single paddle wherein each of the feet and poles are interconnected to a single blade indirectly via a series of cables and pulleys. However, it doesn't allow for independent operation of each pole and foot, and requires the blade to turn 90 degrees to feather the blade on the non-power stroke. Since it only has one blade, much of the efficiency of the cross country motion of two independent feet and two independent poles is lost in interconnecting four movements to one blade. In addition, it requires a separate device to steer the watercraft.

BRIEF SUMMARY OF THE INVENTION

The above problems and more have been overcome with a watercraft that uses a cross country ski simulator to provide propulsion to the watercraft by using one or more of the foot and pole movements of the cross country ski simulator to activate paddles under or on the hull of the watercraft which propel the watercraft.

Accordingly, in one embodiment of the invention, there is a watercraft with a deck, at least one hull, a bow, and a stern having a direct drive cross country ski simulator as a propulsion system for use by a person operating the watercraft, the simulator comprising:

a) four parallel essentially horizontal tracks mounted on the deck of the watercraft wherein there are two inner tracks and two outer tracks wherein each of the inner two tracks are adapted with a foot receiving plate for receiving a foot of the person operating the watercraft and each of the two outer tracks are adapted with a pole receiving plate for receiving a cross country ski pole held by the person operating the watercraft such that the foot receiving plates and the pole receiving plates move in a bow to stern and back direction simulating a cross country ski motion; and b) four paddle blades each having a front face, a back face, and sides, wherein one blade is attached to each pole and each foot receiving plate in a manner that positions the blades below the hull of the watercraft such that the paddle blade moves bow to stern and back and each of the pole or foot plates move bow to stern and back in a manner such that each blade is operated independently of the other three blades, wherein when a blade is moving bow to stern and stern to bow, the blade back face presents a greater surface area perpendicular to the direction of travel in one direction than the blade front face does when the blade is moving in the opposite direction by folding the blade up parallel to the direction of travel.

In another embodiment, there is a method of powering a watercraft with a deck, at least one hull, a bow, and a stern by the actions of a person comprising the person operating the watercraft utilizing a cross country ski simulator as a propulsion system, the simulator for use by a person operating the watercraft, the simulator comprising:

a) four parallel essentially horizontal tracks mounted on the deck of the watercraft wherein there are two inner tracks and two outer tracks wherein each of the inner two tracks are adapted with a foot receiving plate for receiving a foot of the person operating the watercraft and each of the two outer tracks are adapted with a pole receiving plate for receiving a cross country ski pole held by the person operating the watercraft such that the foot receiving plate and the pole receiving plates move in a bow to stern and back direction simulating a cross country ski motion; and b) four paddle blades each having a front face, a back face, and sides wherein one blade is attached to pole and each foot receiving plate in a manner that positions the blades below the hull of the watercraft such that the paddle blade moves bow to stern and back as each of the pole or foot plates move bow to stern and back in a manner such that each blade is operated independently of the other three blades, wherein when a blade is moving bow to stern and stern to bow, the blade back face presents a greater surface area perpendicular to the direction of travel in one direction than the blade front face does when the blade is moving in the opposite direction by folding the blade up parallel to the direction of travel.

DETAILED DESCRIPTION OF THE INVENTION

Figure 1:
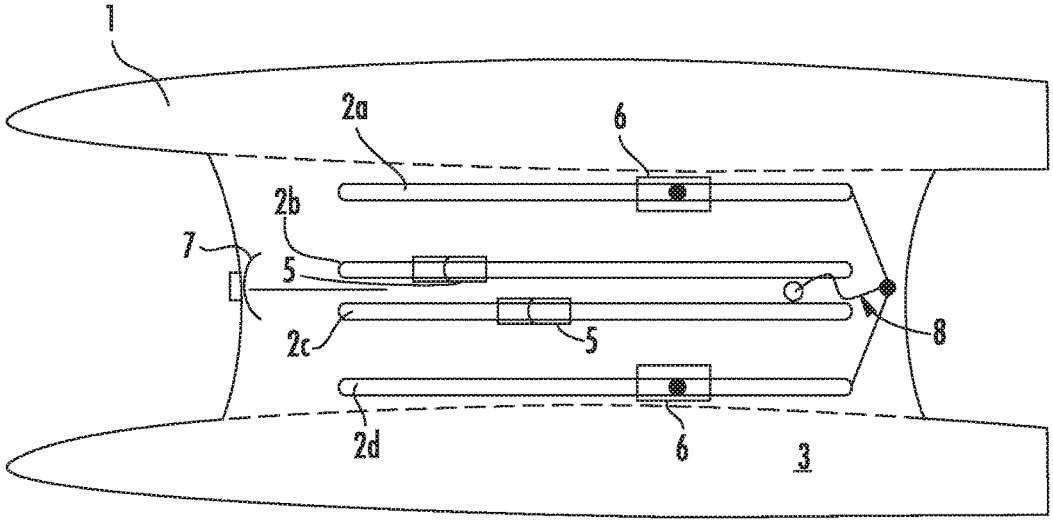
FIG. 1 is a top view of a watercraft with a cross country ski simulator.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "watercraft" refers to a boat or other vessel that floats on the water and travels on the water. The watercraft will have a deck (virtually any upper surface that can hold the cross country simulator), at least one hull, a bow, a stern, and two sides. Since the device is powered by a person, the size and weight of the person operating the watercraft will determine the maximum size and shape of the water craft and such design is within the skill in the art in view of the present disclosure. The use of a singular person herein also refers to multiple devices with multiple people powering a vessel which could in those instances be a larger watercraft.

As used herein, the terms "cross country ski simulator" and "cross country ski movement" refer to an exercise type device that mimics the movements of cross country (Nordic) skiing. Ski machines provide low-impact aerobic exercise. Working out on a ski machine burns roughly the same amount of calories as running; with little or no shock to the joints. Ski machines emulate the act of cross-country skiing, wherein the feet and two ski poles slide back and forth along the ground.

Ski machines consist of foot receiving plates and pole receiving plates that slide forward and back in a motion that mimics the act of using skis and ski poles. Dependent designs mean that the skis are attached, such that as you draw one foot forward, the other goes back automatically. Independent ski machines require you to exert forward pressure with one leg and backward pressure with the other to move the skis. Some machines use independently moving ski poles to demand more work from the arms. In the present invention, there are two foot attachment devices and two pole attachment devices (they each move independently of one another). No skis are needed just like in ski simulators.

In the present invention such a machine, with four independent blades, is mounted on an upper surface of the watercraft and, rather than a separate machine, is part of the watercraft such that a person performing the cross-country ski movements mentioned above will result in the machine driving four independent paddles in the water beneath the watercraft, two of which are attached to each of the two foot attachment devices and the other two are attached to each of the two pole attachment devices (poles can be permanently attached or removable as desired). Such movements can also be utilized to steer the watercraft by changing the relative force on individual paddles, but a separate steering mechanism could also be utilized by the operator of the watercraft.

As used herein, the term "propulsion system" refers to four paddles connected to the receiving foot and pole plates (one each independently attached to each of four paddles) wherein each paddle moves through the water as the person operating the watercraft utilizes the cross country ski simulator machine movement with the present device. As the feet and poles go back and forth, bow to stern and back again, connected paddle blades move back and forth through the water. Since the blades present a greater surface in one direction verses the other, the net is an overall propulsion effect in the water by the four independent blades.

As used herein, the term "person operating the watercraft" refers to the person utilizing the cross country ski simulator portion of the invention.

As used herein, the term "tracks" refers to four parallel essentially horizontal tracks, two inner for the feet and two outer for the poles mounted on the deck of the watercraft. The two inner tracks are adapted with a foot receiving plate for receiving each foot of the person operating the watercraft and the two outer tracks are adapted with pole receiving plates for receiving simulated ski poles (either removable or not removable. as desired). As noted above, the tracks are each independent of one another. They are designed to allow the person operating the watercraft to perform a simulated cross country ski motion and operate the paddle blades under the hull. The force of each foot and each pole movement will determine the force with which the vessel moves and to the extent such movement is eccentric, it can be utilized to turn the vessel.

As used herein, the term "foot receiving plate" refers to a plate, box, shuttle car, or the like adapted to receive the left and right foot of a person utilizing the simulator portion of the invention. It can move back and forth in any manner known in the art such as wheel tracks (as shown in the embodiment in the figures), cable pulleys, or the like. Such choice is within the skill in the art in view of the teaching herein. In one embodiment, the plates are connected together by a set of cables and pulleys to assure that the hull is pushed forward with the operator without the need of another attachment to the operator, such as a "waist pusher or puller" although such devices can be utilized herewith.

As used herein, the term "pole receiving plate" refers to a plate, box, shuttle car or the like adapted to receive the left and right ski pole (in a fixed or removable manner) of a person utilizing the simulator portion of the invention. It can move back and forth (bow to stern, e.g.) in any manner known in the art such as wheel tracks (as shown in the embodiment in the figures), cable pulleys, or the like. Such choice is within the skill in the art in view of the teaching herein. In one embodiment, the plates are connected to a resistance device. The poles can be either fixed or removable.

As used herein, the term "bow to stern direction" refers to, in general, the person operating the watercraft, simulator, and direction of travel being aligned so the person operating the watercraft is facing the direction of travel. That will be a front to back of the watercraft direction as can be seen in the figures. While other positions could be utilized with multiple devices and people on the same watercraft, one needs to generally face the direction of travel.

Figure 5:
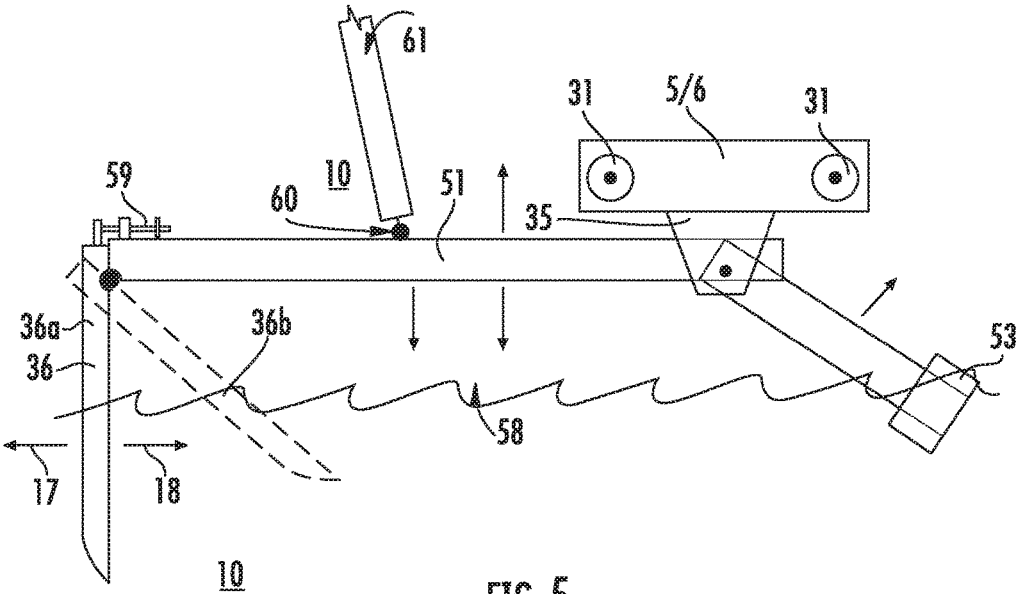
FIG. 5 is a side view of a receiving plate attached to a paddle.

As used herein, the term "paddle blades" refers to a tool used for pushing against water as a form of propulsion in a watercraft. A paddle blade has a front face, back face, and sides wherein the front and back faces present a greater surface area than the edges of the blades do (see the figures for examples). The side of the greater surface area front is dragged through the water and facing toward the direction of travel while the blade folds upward either back to front or front to back to provide a smaller surface area in the return to the front to create greater force driving the watercraft forward than in reverse. The angle of folding up blade can be adjusted. This is often called feathering the blade which can be done by folding up the blade, as shown in the figures, while moving the blade stern to bow direction. In one embodiment, the blade face is essentially vertical to the direction of travel of the watercraft with the receiving place moving bow to stern and folds up at least partially horizontally (as shown in FIG. 5) as the blade moves from a stern to bow position. In one embodiment, the angle of the blade can be adjusted. In another embodiment, the blades are counter weighted to provide easier lifting of the paddle at the back portion of the track. In another embodiment, the blade can fold up as shown in the figures. In one embodiment, the blades are directly connected to the foot or paddle receiving plate while in another embodiment, there is a connecting arm connecting each slide to a blade, as shown in the figures. In another embodiment, the blades and blade arms are counterweighted by an adjustable elastomeric device.

As used herein, the term "waist pusher and waist puller" refers to an optional device for connecting to the person operating the watercraft either in the front or from behind the person operating the watercraft that keeps the person operating the watercraft in place and gives the person operating the watercraft something to lean against or push or pull on to allow the cross country skiing motion to propel the water craft forward. Another embodiment uses a set of pulleys and cables that connect the two foot plates such that when one plate moves one direction, the other plate moves exactly as much in the opposite direction. This would also allow the operator's forward motion to be transferred to the forward motion of the hull, and would negate the need of a waist pusher or puller.

DRAWINGS

Now referring to the figures, FIG. 1 is a top view of the watercraft of the present invention. Watercraft 1 has four tracks 2*a*, 2*b*, 2*c*, and 2*d* mounted on the deck 3 of watercraft 1. Inner tracks 2*b* and 2*c* have foot receiving plates 5 positioned for a person's feet using the plates in cross country ski simulation. The outer tracks 2*a* and 2*d* have pole receiving plates 6 positioned for use with ski poles in a cross country simulation. Also shown is a body restraining device (operator restraining device) consisting of a padded belt secured around the waist of the operator that is affixed to a forward post 7 or a rear post 8, or both, by means of a rigid horizontal extension or flexible cord to provide a means for the operator to push or pull the watercraft forward. It will be appreciated that when using the watercraft there is a tendency for the operator's body to move forward relative to the hull of the watercraft. The body restraining device thereby prevents the operator's body from moving forward or straying from a centered location on the watercraft. From the centered position the operator can more effectively move the foot and pole plates through the full range of the tracks on the deck of the watercraft.

Figure 2:
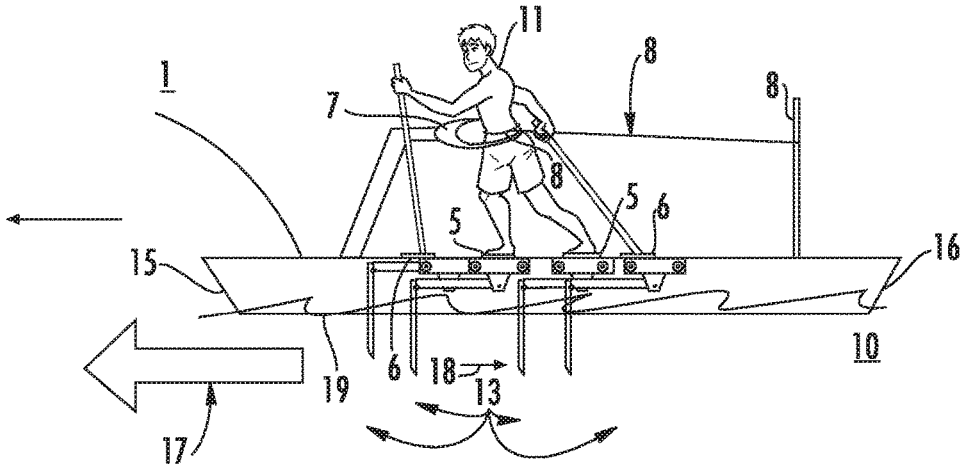
FIG. 2 is a side and partial underwater view of the watercraft with a person using a cross country ski simulator to activate paddles under the hull and move the watercraft.

In FIG. 2 there is a side view of the watercraft 1 in the water 10 with person 11 operating the watercraft 1 by performing a cross country ski movement. The foot receiving plates 5 and pole receiving plates 6 are shown to connect to blades 13 positioned under hull 19 which move in the same direction as the foot receiving plates 5 and pole receiving plates 6 direction, i.e. bow 15 to stern 16. Arrow 17 indicates direction of watercraft 1 travel while direction 18 indicates travel of blades 13 when moving the watercraft 1 in direction 17.

Figure 3:
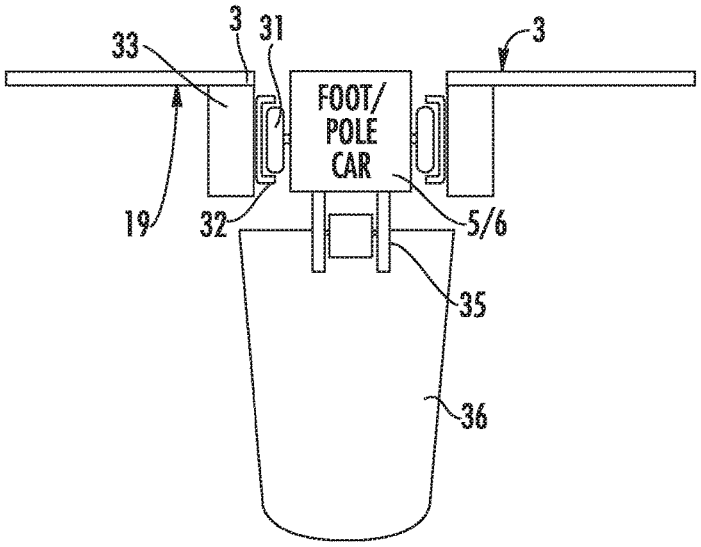
FIG. 3 is a rear view of a foot or pole receiving plate and how it moves in one embodiment.
Figure 4:
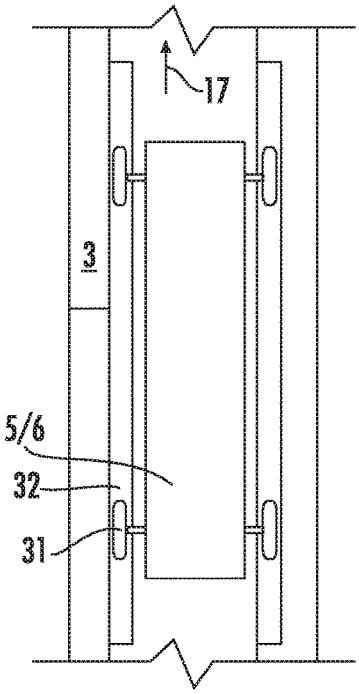
FIG. 4 is a top view of a foot or pole receiving plate.

FIG. 3 is a rear view of the foot or pole receiving plate 5 and 6 which shows it travels with a wheel 31 and track 32 mounted on supports 33 similar to that which a garage door moves except in a straight line back and forth. The plates have connector 35 which attaches paddle blade 36 to the foot or pole receiving plate. FIG. 4 is a top view of the same plate.

FIG. 5 is a side view of another embodiment wherein a more elaborate paddle blade 36 attachment is shown as well as one embodiment of changing the surface area presented by the paddle blade 36. Paddle blade 36 is attached to mounting arm 51 which is mounted to connecter 35. The angle of the paddle blade 36 can be adjusted relative to the mounting arm by an adjustment device 59. In this view, there is a counter weight 53 used to balance the paddle blade 36 extending out on the mounting arm 51. As the foot and pole receiving plates 5 or 6 move in direction 17 or 18, the paddle blade 36 moves in the same direction. In one embodiment, in order to present a smaller surface area when the blade moves toward the bow of the boat, paddle blade 36 has paddling position 36*a* when the plate moves bow to stern and folded up in an essentially horizontal position 36*b* which presents less of a surface area when returning toward the bow of the watercraft (not shown in this view). In order to assist in the raising of the paddle during the forward stroke, an adjustable elastomeric device is attached to the paddle arm which exerts an upward force to counteract the weight of the paddle and arm. In addition, another adjustable elastomeric device (shown in FIGS. 6*a* and 6*b*) applies a force which returns the paddle to its vertical position once the blade has stopped moving forward. The pole 61 attached to the pole plate and paddle assembly of FIG. 5 could have their attachment points 60 on the paddle arms themselves so that pulling the pole 61 upwards at the end of the back stroke would result in pulling the paddle out of the water. Other embodiments for raising the paddle out of the water on the forward stroke could include, but are not limited to, using foot motion, or water resistance according to the art.

Figure 6A:
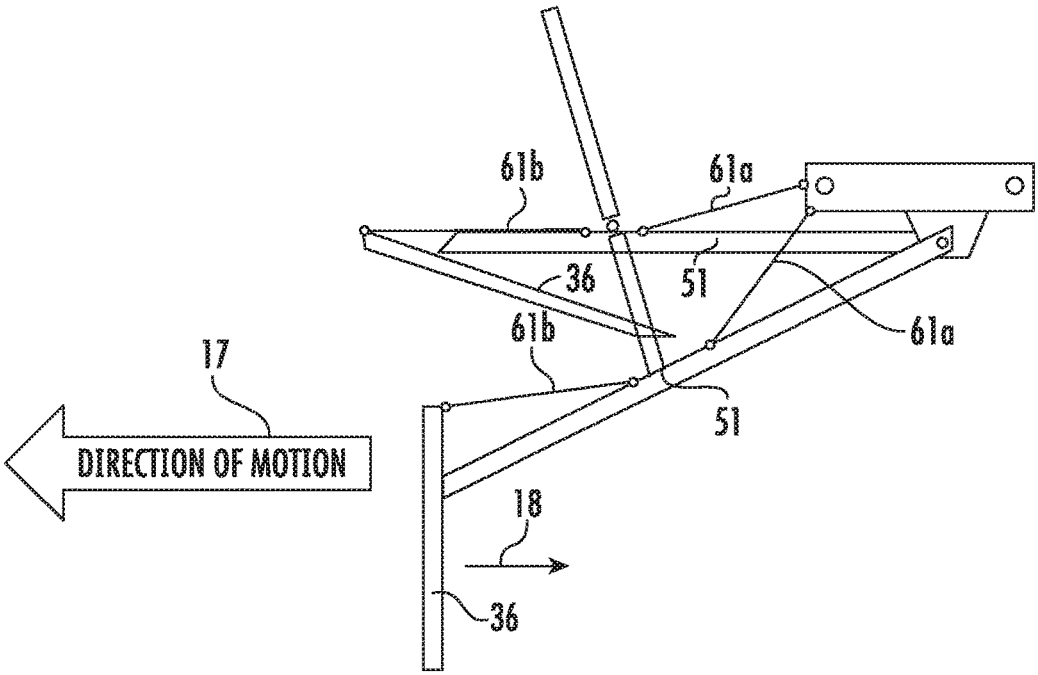
FIGS. 6*a* and 6*b* show opposing positioning of the mounting arms and elastomeric devices to provide adjustable counter balance to the weight of the blade and mounting arms.

In FIG. 6*a*, an alternate means for returning both the arm 51 and paddle 36 back to a starting position is shown useful in an embodiment for either the pole or foot tracks. The counterweight 55 has been removed as well as the arm that attaches it to the paddle arm 51. In order to assist in the raising of the paddle in this configuration during the forward stroke, an elastomeric device 61*a* is attached to paddle arm 51 which has a sufficient pulling force to exert enough upward force to counteract the downward force due to the weight of the paddle 36 and arm 51. Another elastomeric device 61*b* applies a pulling force sufficient to return the paddle 36 to a vertical position once the paddle has stopped moving forward. The arm and paddle are shown in two positions on one drawing for convenience and comparison.

Figure 6B:
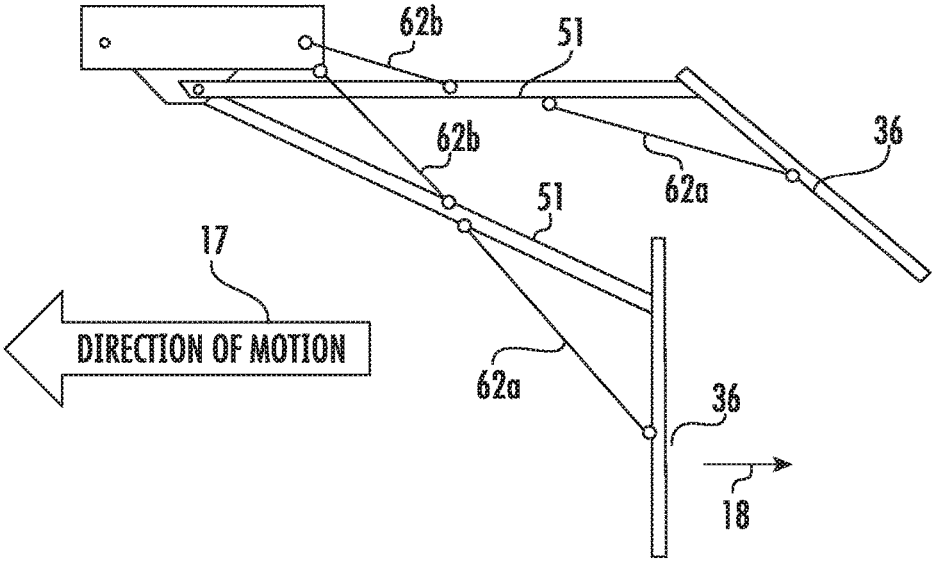

In another embodiment shown in FIG. 6*b*, there is an alternate version of either the foot or pole tracks wherein the paddle arms 36 extend rearward rather than forward. Once again, in this version elastomeric devices are utilized. In this view, a blade return elastic 62*a* is shown as well as an arm lifting elastomer 62*b*. In both FIGS. 6*a* and 6*b*, the elastomeric device can be adjustable.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A watercraft with a deck, at least one hull, a bow, and a stern having a direct drive cross country ski simulator as a propulsion system for use by an operator of the watercraft, the simulator comprising:

a) four parallel essentially horizontal tracks mounted on the deck of the watercraft wherein there are two inner tracks and two outer tracks wherein each of the inner two tracks are adapted with a foot receiving plate for receiving a foot of the operator of the watercraft and each of the two outer tracks are adapted with a pole receiving plate for receiving a cross country ski pole held by the operator of the watercraft such that the foot receiving plates and the pole receiving plates move in a bow to stern and back direction simulating a manual cross country ski motion by the operator; and b) four paddle blades each having a front face, a back face, and sides, wherein one blade is attached to each pole and each foot receiving plate in a manner that positions the blades below the hull of the watercraft such that the paddle blade moves bow to stern and back and each of the pole or foot plates move bow to stern and back by virtue of the manual application of forces by the hands and feet of the operator of the watercraft in a manner such that each blade is manually operated independently of the other three blades, wherein when a blade is moving bow to stern and stern to bow, the blade back face presents a greater surface area perpendicular to the direction of travel in one direction than the blade front face does when the blade is moving in the opposite direction by manual application of force by the hands or feet which folds the blade around a fulcrum hinge to a position parallel to the direction of travel.

2. The watercraft according to claim 1 wherein the receiving plates move bow to stern and back using a wheel in track system.

3. The watercraft according to claim 1 wherein the blade is essentially perpendicular to the direction of travel of the watercraft when the pole is or receiving plates are moving bow to stern and folds upward as the blade moves from a stern to bow position.

4. The watercraft according to claim 1 wherein the apparent weight of each of the blades is reduced from a baseline by an elastomeric counterweight.

5. The watercraft according to claim 4 wherein each blade has an elastomer attached to the paddle arm which exerts an upward force to counteract the weight of the paddle and the arms.

6. The watercraft according to claim 1 wherein the angle the blade presents in the water can be manually adjusted during operation.

7. The watercraft according to claim 1 which further comprises a restraining device consisting of a belt secured around the waist of the operator of the watercraft that is affixed to a forward post, a rear post or both.

8. The watercraft according to claim 1 wherein the blades are each attached to a separate mounting arm and the mounting arms are each independently attached to a foot plate or a pole plate.

9. The watercraft according to claim 8 wherein the blade can fold around a fulcrum hinge to a position horizontal to the direction of travel when moving forward and vertical to the direction of travel when moving backward.

10. A method of powering a watercraft with a deck, at least one hull, a bow, and a stern by the actions of an operator of the watercraft comprising the person utilizing a cross country ski simulator as a propulsion system, the simulator for use by the operator operating the watercraft, the simulator comprising:

a) four parallel essentially horizontal tracks mounted on the deck of the watercraft wherein there are two inner tracks and two outer tracks wherein each of the inner two tracks are adapted with a foot receiving plate for receiving a foot of the operator and each of the two outer tracks are adapted with a pole receiving plate for receiving a cross country ski pole held by the operator of the watercraft such that the foot receiving plate and the pole receiving plates move in a bow to stern and back direction simulating a manual cross country ski motion by the operator; and b) four paddle blades each having a front face, a back face, and sides wherein one blade is attached to pole and each foot receiving plate in a manner that positions the blades below the hull of the watercraft such that the paddle blade moves bow to stern and back as each of the pole or foot plates move bow to stern and back by virtue of the manual application of forces by the hands and feet of the operator of the watercraft in a manner such that each blade is manually operated independently of the other three blades, wherein when a blade is moving bow to stern and stern to bow, the blade back face presents a greater surface area perpendicular to the direction of travel in one direction than the blade front face does when the blade is moving in the opposite direction by manual application of force by the hands or feet which folds the blade around a fulcrum hinge to a position parallel to the direction of travel.

* * * * *